US005287599A

United States Patent [19]

Leifeld

[11] Patent Number: 5,287,599

[45] Date of Patent: Feb. 22, 1994

[54] DUCTWORK WITH SENSOR AND PIVOTING GATE FOR FIBER IMPURITY REMOVAL

[75] Inventor: Ferdinand Leifeld, Kempen 1, Fed. Rep. of Germany

[73] Assignee: Trützschler GmbH & Co. KG, Möchengladbach, Fed. Rep. of Germany

[21] Appl. No.: 946,647

[22] Filed: Sep. 18, 1992

[30] Foreign Application Priority Data

Sep. 19, 1991 [DE] Fed. Rep. of Germany ..... 4131188

[51] Int. Cl.[5] ..... D01G 23/08; D01G 9/08

[52] U.S. Cl. ..... 19/205; 209/555; 209/570

[58] Field of Search ..... 19/107, 135, 139.1, 19/200, 205, 65 R, 66 R, 66 CC; 209/546, 555, 570, 657; 406/11, 34, 121, 115, 157, 159, 168, 171, 183

[56] References Cited

U.S. PATENT DOCUMENTS

| | | | |
|---|---|---|---|
| 3,435,484 | 4/1969 | Langdon | 19/205 |
| 4,480,753 | 11/1984 | Thomas et al. | 209/570 X |
| 4,753,353 | 6/1988 | Kramer | 209/570 |
| 4,763,792 | 8/1988 | Kind | 209/570 |
| 4,866,815 | 9/1989 | Lucassen | 19/205 |
| 4,977,645 | 12/1990 | Hösel | 19/200 |

FOREIGN PATENT DOCUMENTS

| | | | |
|---|---|---|---|
| 000033 | 12/1878 | Fed. Rep. of Germany . | |
| 0104558 | 9/1898 | Fed. Rep. of Germany | 19/205 |
| 488332 | 12/1929 | Fed. Rep. of Germany . | |
| 1510222 | 7/1970 | Fed. Rep. of Germany . | |
| 3738382 | 6/1988 | Fed. Rep. of Germany . | |
| 3825109 | 2/1990 | Fed. Rep. of Germany . | |
| 3929667 | 5/1990 | Fed. Rep. of Germany . | |
| 0236858 | 7/1925 | United Kingdom | 19/205 |
| 2200374 | 8/1988 | United Kingdom | 19/205 |
| 2249323 | 9/1990 | United Kingdom | 19/205 |
| 2248637 | 4/1992 | United Kingdom . | |

*Primary Examiner*—Clifford D. Crowder
*Assistant Examiner*—Ismael Izaguirre
*Attorney, Agent, or Firm*—Spencer, Frank & Schneider

[57] ABSTRACT

An apparatus for separating foreign matter from a pneumatically conveyed stream of textile fibers has a pneumatic duct in which the textile fibers are conveyed by an air stream; a waste container; first and second coupling openings for maintaining communication between the waste container and the pneumatic duct; and a gate pivotally supported in the pneumatic duct. The gate has a first position maintaining open the pneumatic duct and obturating the first and second coupling openings for allowing the fiber material to be conveyed by the air stream through the duct by bypassing the waste container. The gate further has a second position obturating a direct passage through the pneumatic duct and maintaining open the first and second coupling openings for directing the fiber material and the air stream from the pneumatic duct into the waste container and for allowing conveying air to pass from the waste container back into the pneumatic duct. The apparatus further has a detector for detecting foreign matter in the fiber material; and a control device connected to the detector and the gate for pivoting the gate from the first position into the second position upon detection of foreign matter by the detector.

19 Claims, 3 Drawing Sheets

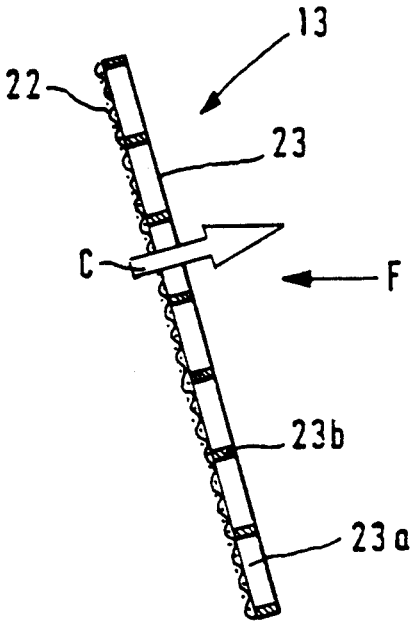
FIG. 3a
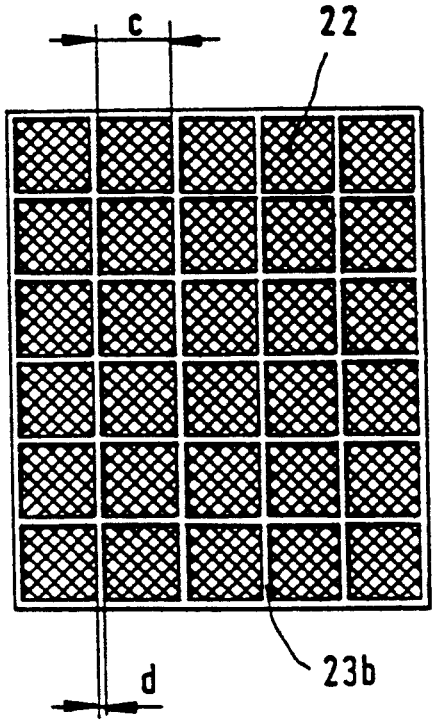
FIG. 3b
FIG. 4
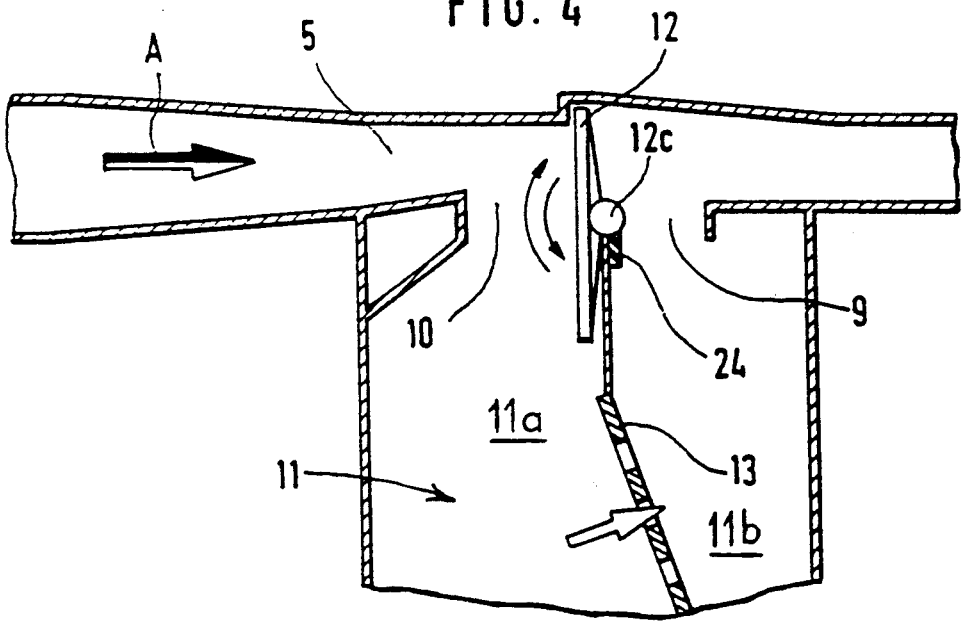

DUCTWORK WITH SENSOR AND PIVOTING GATE FOR FIBER IMPURITY REMOVAL

CROSS REFERENCE TO RELATED APPLICATION

This application claims the priority of German Application No. P 41 31 188.4 filed Sep. 19, 1991, which is incorporated herein by reference.

BACKGROUND OF THE INVENTION

The invention relates to an apparatus provided in a pneumatic duct for conveying fiber tufts therein, particularly in the spinning preparation phase and includes a detector for detecting foreign matter, such as metal particles and sparks, and a downstream-arranged deflecting gate which is controlled by the detector and which, when the detector emits a sensing signal, moves pivotally into a position in which it closes the pneumatic duct and at the same time opens a first coupling opening in the pneumatic duct. The first coupling opening leads to a waste container. The apparatus also includes a normally closed second coupling opening leading to the waste container.

In a known apparatus of the above-outlined type two gates are provided: one gate serves for obturating the pneumatic duct and to open or close the first coupling opening, whereas the second gate opens or closes the second coupling opening. The second gate is spring-biased into the closed position so that it opens the second coupling opening by virtue of the pressure which builds up in front of the first gate as a result of the closing of the pneumatic duct by the first gate. The use of two gates renders the device structurally complex and also complicates installation. It is a further disadvantage of the prior art constructions that when the spring bias or the pivotal support of the second gate is interfered with, the latter may remain partially or entirely closed which prevents the separation of the fiber material and may lead to undesired excessive pressures.

SUMMARY OF THE INVENTION

It is an object of the invention to provide an improved apparatus of the above-outlined type from which the discussed disadvantages are eliminated and which has a simple and operationally reliable structure.

This object and others to become apparent as the specification progresses, are accomplished by the invention, according to which, briefly stated, the apparatus for separating foreign matter from a pneumatically conveyed stream of textile fibers has a pneumatic duct in which the textile fibers are conveyed by an air stream; a waste container; first and second coupling openings for maintaining communication between the waste container and the pneumatic duct; and a gate pivotally supported in the pneumatic duct. The gate has a first position maintaining open the pneumatic duct and obturating the first and second coupling openings for allowing the fiber material to be conveyed by the air stream through the duct by bypassing the waste container. The gate further has a second position obturating a direct passage through the pneumatic duct and maintaining open the first and second coupling openings for directing the fiber material and the air stream from the pneumatic duct into the waste container and for allowing conveying air to pass from the waste container back into the pneumatic duct. The apparatus further has a detector for detecting foreign matter in the fiber material; and a control device connected to the detector and the gate for pivoting the gate from the first position into the second position upon detection of foreign matter by the detector.

Thus, according to the invention a single closing gate is provided which closes one path (obturation of the pneumatic duct) and simultaneously opens two paths, namely, the first and second coupling opening between the pneumatic duct and the waste container. In the non-obturating position the single closing gate closes both the first and the second coupling opening. The use of a single gate significantly simplifies structure and installation as compared to prior art arrangements. Furthermore, the second coupling opening is positively opened in an operationally reliable manner by the sole closing gate.

The device according to the invention has the following additional advantageous features:

The pivotal axis of the closing gate passes through the middle thereof to form a butterfly gate.

The closing gate is a one-piece component.

At the inner wall of the pneumatic duct an abutment is provided which during obturation is in engagement with the edge zone of one of the wings of the pivotal butterfly gate.

Opposite the abutment there is provided a seating face which at least partially receives the other wing of the butterfly gate when it blocks direct flow through the pneumatic duct.

The closing gate is connected to a drive such as a pneumatic power cylinder.

The pivotal axis of the closing gate is arranged on that side thereof which is oriented in the same direction as the material flow in the pneumatic duct.

In an apparatus in which the waste container is divided into two parts by a separating sieve, the latter is of such fineness that flames and sparks may not pass therethrough.

The separating sieve has a fineness of approximately 0.1–0.3 mm.

The separating sieve is of high grade steel.

The separating sieve is secured to a perforated sheet metal plate.

The first coupling opening is traversed by a sieve, for example, a wire mesh.

A waste-collecting carriage is provided underneath the waste container.

The waste container has a tightly closing, pivotal gate at its underside.

The device according to the invention is associated with the pneumatic duct between a bale opener and a successive fiber processing station.

BRIEF DESCRIPTION OF THE DRAWINGS

FIG. 3*a* is a sectional elevational view of a component forming part of the preferred embodiment.

FIG. 3*b* is an end elevational view of the component shown in FIG. 3*a*.

FIG. 4 is a sectional side elevational view of the preferred embodiment, showing further details.

DESCRIPTION OF THE PREFERRED EMBODIMENT

Figure 1:
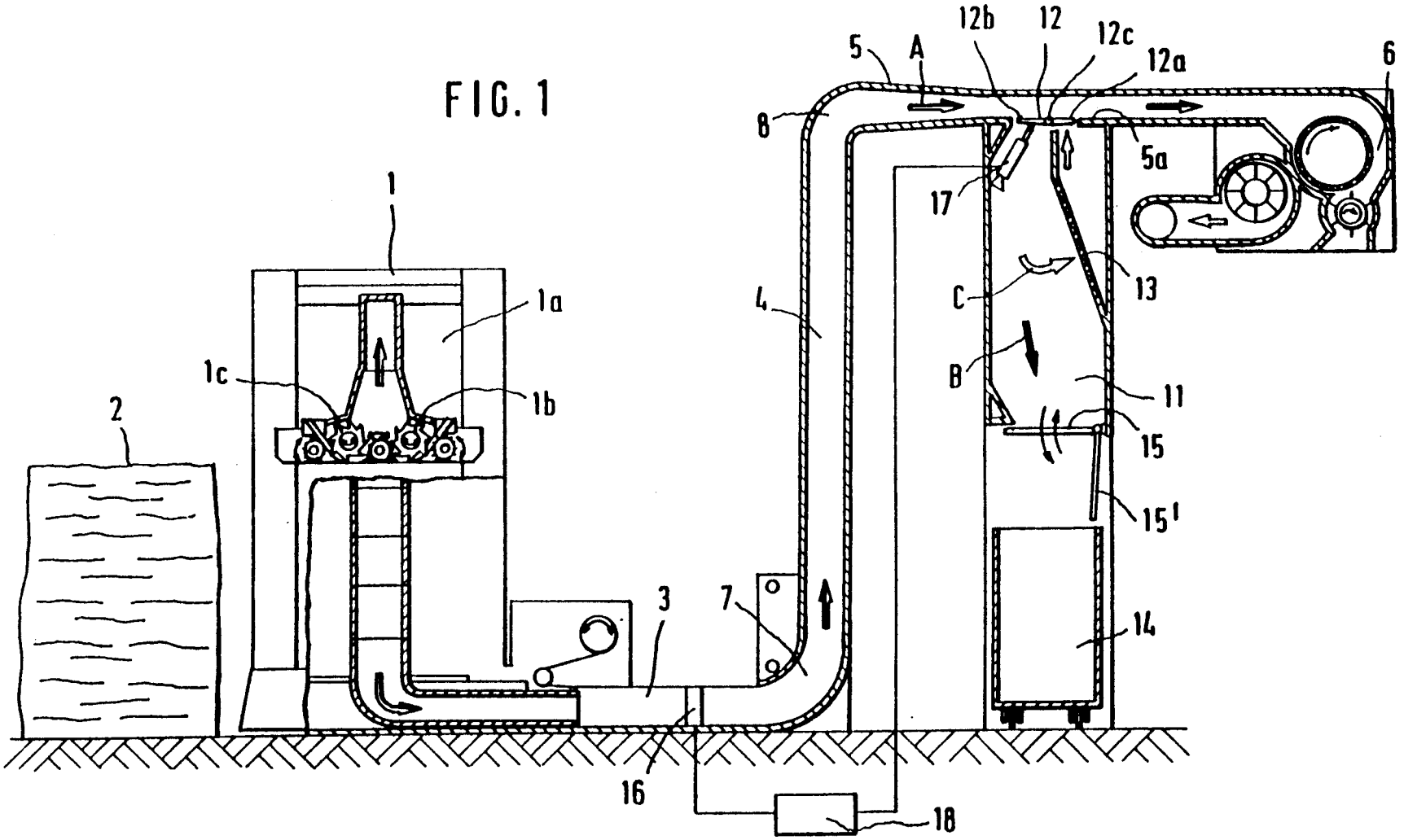
FIG. 1 is a schematic sectional side elevational view of a bale opener, a pneumatic duct carrying fiber tufts from the bale opener and a preferred embodiment of the invention installed in the duct.

Turning to FIG. 1, there is illustrated therein a bale opener 1 which may be, for example, a BLENDOMAT model, manufactured by Trützschler GmbH & Co. KG, Mönchengladbach, Germany. A travelling detaching device ia, provided with rapidly rotating opening rolls 1*b* and 1*c*, removes fiber tufts from the top face of fiber bales. The fiber material may contain foreign metal bodies which, if admitted into successive fiber processing machines, may cause operational disturbances. If such metal components are caught by the rapidly rotating opening rolls 1*b* and 1*c*, sparks may be generated which could ignite the fiber material. The fiber tufts are pneumatically conveyed in a horizontal suction duct 3 and then are admitted through fiber conveying conduits 4 and 5 into a downstream-arranged fiber processing machine 6. Between the suction duct 3 and the conveying conduit 4 (that is, an upright, rising conduit portion) a bend 7 is provided and between the vertical conduit 4 and the horizontal conduit 5 a bend 8 is connected.

Figure 2:
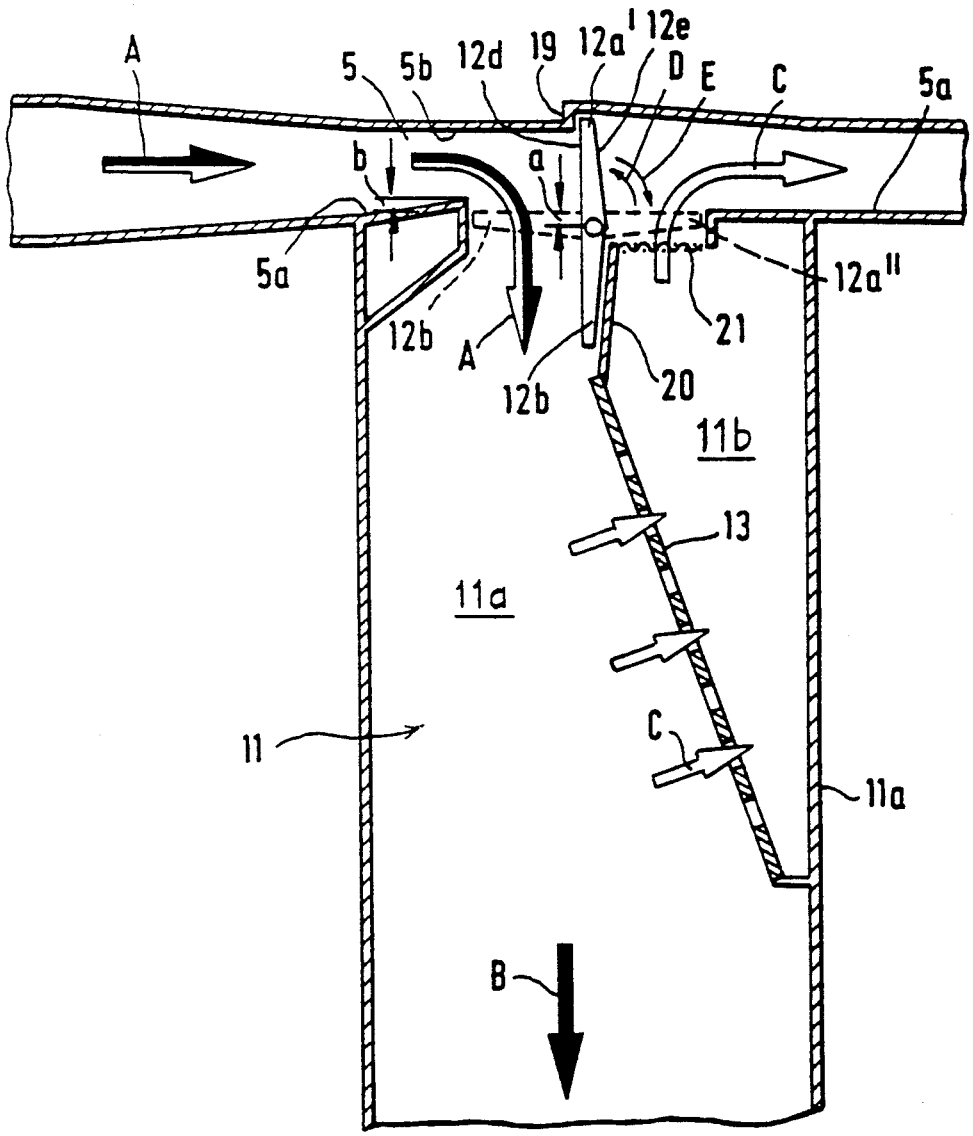
FIG. 2 is a sectional side elevational view on an enlarged scale of the preferred embodiment, showing further details.

Also referring to FIGS. 2 and 4, in the conduit 5 there are provided a first coupling opening 9 and a second coupling opening 10 underneath which waste container 11 is arranged for collecting fiber tufts contaminated with burns or metal components. In the region of the coupling openings 9 and 10 a pivotal gate 12 is provided whose two wings 12*a* and 12*b* close the coupling openings 9 and 10 in the position illustrated in FIG. 1 and in the phantom-line position shown in FIG. 2. As seen in FIG. 2, the pivot axis 12*c* which is perpendicular to the flow direction A in the duct 5, extends in the middle of the one-piece gate 12 at a distance a underneath the plane of the inner wall face 5*a* of the duct 5 so that the face 12*d* of the pivotal gate 12 lies substantially in the plane of the inner wall face 5*a* of the duct 5 in the phantom-line position of the gate 12.

The waste container 11 is divided into two compartments 11*a* and 11*b* by a separating sieve 13. The coupling opening 10 is in communication with the inner space of the compartment 11*a*, whereas the coupling opening 9 is in communication with the inner space of the compartment 11*b*. Underneath the waste container 11 a carriage 14 is provided. The waste container 11 has at it underside a pivotal gate 15 which may close off the bottom of the waste container 11 in a sealed manner and which may open and close the outlet opening to control the flow of contaminated material into the carriage 14.

Reverting once again to FIG. 1, upstream of the closing gate 12, as viewed in the direction of advance A of fiber tufts in the pneumatic conduit, at the end of the channel 3 a detector 16, such as an infrared sensor is arranged which responds if a spark is generated. The closing gate 12 and its setting member 17, for example, a pneumatic cylinder, are connected with a control device 18 in such manner that the gate 12 is rotated from the phantom-line position to the solid-line position illustrated in FIG. 2, when, for example, a spark passes through the region of the detector 16. Between the gate 12 and the detector 16 two bends 7 and 8 having a 90° turn are provided so that for accommodating the reaction time between spark recognition and switchover of the gate 12 a sufficiently long conduit is present and further, by using a rising conduit portion 4, a significant saving of horizontal space is ensured.

In FIG. 2, when the gate 12 is in its solid-line position in which flow of material in the pneumatic duct 5 is interrupted and the fiber tufts are diverted into the waste container 11, the outer edge zone 12*a*' of the surface 12*d* of the gate wing 12*a* abuts against a shoulder (stop) 19 provided in the wall portion 5*b* of the duct 5. Across from the shoulder 19, in the region underneath the pivot axis 12*c*, a seating face 20 is provided which at least partially receives the other wing 12*b* of the gate 12. As shown in FIG. 2, the coupling opening 9 is traversed by a wire mesh 21 which, in the phantom-line position of the gate 12, is obturated by the rear face 12*e* of the wing 12*a* underneath the pivot axis 12*c*. The end of the gate wing 12*b* is, in the phantom-line position of the gate 12, at a distance b underneath the inner wall face 5*a* so that the fiber material advanced in the direction A may slide off the face 5*a* and drop onto the upper horizontal face of the gate 12.

During normal operation, that is, when no spark or metal body is detected, the gate 12 is in its phantom-line position of FIG. 2. In this position the wings 12*a* and 12*b* maintain closed the respective first and second coupling openings 9 and 10. As soon as the detector 16 emits a signal indicating the presence of a spark or a metal body, the gate 12 is, by means of the pneumatic cylinder 17, pivoted about 90° counterclockwise into its solid-line position whereby the wing 12*a* obturates the pneumatic duct 5 and frees the first coupling opening 9 whereas the wing 12*b* frees the second coupling opening 10. Thus, by pivoting the sole gate 12 in the direction of the arrow D one path (the pneumatic duct 5) is closed whereas two paths (the first and the second coupling openings 9 and 10, respectively) are simultaneously opened. The wing 12*a* is rotated in the direction of the arrow D opposite the flow direction A from the non-obturating position 12*a*'' into the obturating position 12*a*'. The gate 12 may be pivoted back into the non-obturating position as indicated by the arrow E.

The separating sieve 13 extends obliquely from the lower end of the abutment surface 20 downwardly to the wall surface 11*a* so that the compartment 11*a*, which is the waste container proper, is enlarged downwardly.

Turning to FIGS. 3*a* and 3*b*, the separating sieve 13 is formed of a wire mesh 22 which is secured to an apertured sheet metal plate 23. The plate 23 faces that part of the waste container 11 which is underneath the second coupling opening 10, whereas the wire mesh 22 faces that part of the waste container 11 which is underneath the first coupling opening 9. In this manner the air stream designated at C urges the wire mesh 22 against the supporting apertured plate 23. The mesh 22 effectively closes the duct 5 for the fiber tufts and foreign matter: it allows solely air to pass through. The fiber tufts, as long as the duct 5 is closed by the gate 12, are collected in the waste container 11. The apertured plate 23 has rectangular passages 23*a* having a side length c=20 m and webs 23*b* having a width d=4 mm. It is feasible, however, to provide circular openings instead. The wire mesh 22 has a mesh width (that is, the inner width between two adjoining wires) of approximately 0.2 mm and a wire diameter of approximately 0.15 mm. FIG. 3*b* shows the separating sieve 13 as viewed in the direction of the arrow F of FIG. 3*a*.

Turning once again to FIG. 4, there is shown the gate 12 in the obturating position, that is, the pneumatic duct 5 is closed. At the same time, the first coupling opening 9 and the second coupling opening 10 are opened. A seal 24 is provided between the separating sieve 13 and the pivotal shaft 12*c*.

It will be understood that the above description of the present invention is susceptible to various modifications, changes and adaptations, and the same are intended to be comprehended within the meaning and range of equivalents of the appended claims.

What is claimed is:

1. An apparatus for separating foreign matter from a pneumatically conveyed stream of textile fibers, comprising (a) a pneumatic duct in which the textile fibers are conveyed by an air stream; said pneumatic duct having a first length portion and an adjoining second length portion;

(b) a waste container adjacent said pneumatic duct;

(c) means defining a first coupling opening for maintaining communication between said waste container and said second length portion of said pneumatic duct;

(d) means defining a second coupling opening for maintaining communication between said waste container and said first length portion of said pneumatic duct;

(e) a gate pivotally supported in said pneumatic duct; said gate having a first position maintaining open a direct passage between said first and second length portions and obturating said first and second coupling openings for allowing the fiber material to be conveyed by the air stream directly from said first length portion into said second length portion; said gate having a second position obturating the direct passage between said first and second length portions and maintaining open said first and second coupling openings for directing the fiber material and the air stream from said first length portion of said pneumatic duct through said second coupling opening into said waste container and for allowing conveying air to pass from said waste container into said second length portion of said pneumatic duct;

(f) a detector situated upstream of said second coupling opening as viewed in a direction of advance of said fiber material in said pneumatic duct, for detecting impurities in the fiber material; and (g) control means connected to said detector and said gate for pivoting said gate from said first position into said second position upon detection of foreign matter by said detector 2. The apparatus as defined in claim 1, wherein said first length portion of said pneumatic duct has an inner face adjoining said second coupling opening; said gate having a surface oriented parallel to said direction of advance in said first position of said gate and facing said passage; said surface of said gate being situated below said inner face of said pneumatic duct.

3. The apparatus as defined in claim 1, wherein said control means comprises a pneumatic cylinder coupled to said gate.

4. The apparatus as defined in claim 1, wherein said gate comprises a pivot axis dividing said gate into two halves; one half constituting a first gate wing and the other half constituting a second gate wing.

5. The apparatus as defined in claim 1, further comprising an abutment formed in said pneumatic duct; said first gate wing having a marginal portion being in engagement with said abutment in said second position of said gate.

6. The apparatus as defined in claim 5, further comprising an engagement face formed in said pneumatic duct adjacent said abutment; said second gate wing at least partially engaging said engagement face in said second position of said gate.

7. The apparatus as defined in claim 4, wherein said gate is a one-piece component.

8. The apparatus as defined in claim 1, wherein said first length portion, of said pneumatic duct has an inner face adjoining said second coupling opening; said pivot axis being situated externally of said passage at a distance from said inner face; said distance being measured perpendicularly to said direction of advance.

9. The apparatus as defined in claim 6, wherein said pivot axis is oriented perpendicularly to a direction of advance of said fiber material in said first length portion of said pneumatic duct.

10. The apparatus as defined in claim 6, wherein in said second position of said gate said pivot axis being situated between said gate and said first coupling opening.

11. The apparatus as defined in claim 6, wherein said second gate wing obturates said first coupling opening in said first position and is pivotal into said second position in a direction opposite to a direction of advance of fiber material in said first length portion of said pneumatic duct.

12. The apparatus as defined in claim 1, further comprising a screen dividing said waste container into first and second compartments; in said second position of said gate said first length portion of said pneumatic duct communicating with said first compartment through said second coupling opening and said second length portion of said pneumatic duct communicating with said second compartment through said first coupling opening; said screen having a fineness sufficient to prevent flames and sparks from passing therethrough.

13. The apparatus as defined in claim 12, wherein said screen is of high grade steel.

14. The apparatus as defined in claim 12, further comprising a perforated sheet metal plate; said screen being secured face-to-face to said sheet metal plate.

15. The apparatus as defined in claim 12, wherein said screen has a mesh size of about 0.1 to 0.3 mm.

16. The apparatus as defined in claim 1, wherein said waste container has a bottom discharge opening; further comprising a carriage movable underneath said discharge opening of said waste container for receiving waste therefrom.

17. The apparatus as defined in claim 1, wherein said waste container has a bottom discharge opening; further comprising an openable and closable closure member for opening or hermetically closing said bottom discharge opening.

18. The apparatus as defined in claim 1, in combination with first and second fiber processing machines; said pneumatic duct connecting the first and second machines together for delivering loose fiber from the first machine to the second machine; said apparatus being coupled to said pneumatic duct between said first and second fiber processing machines.

19. The apparatus as defined in claim 18, wherein said first fiber processing machine is a bale opener.

* * * * *

UNITED STATES PATENT AND TRADEMARK OFFICE

CERTIFICATE OF CORRECTION

PATENT NO. : 5,287,599

DATED : February 22, 1994

INVENTOR(S) : Ferdinand Leifeld et al

It is certified that error appears in the above-indentified patent and that said Letters Patent is hereby corrected as shown below:

On the title page, item [75], the second inventor's name and address should read --Bernd Rübenach, Mönchengladbach, Germany--.

Signed and Sealed this

Twentieth Day of September, 1994

*Attest:*

Bruce Lehman

BRUCE LEHMAN

*Attesting Officer*

*Commissioner of Patents and Trademarks*